US007886939B2

(12) United States Patent
Michaux

(10) Patent No.: US 7,886,939 B2
(45) Date of Patent: Feb. 15, 2011

(54) FLUID PRODUCT DISPENSING HEAD AND DEVICE INCORPORATING SAME

(75) Inventor: Sebastien Michaux, Elbeuf (FR)

(73) Assignee: Valois SAS, Le Neubourg (FR)

( * ) Notice: Subject to any disclaimer, the term of this patent is extended or adjusted under 35 U.S.C. 154(b) by 446 days.

(21) Appl. No.: 11/915,939

(22) PCT Filed: Jun. 1, 2006

(86) PCT No.: PCT/FR2006/050498

§ 371 (c)(1),
(2), (4) Date: Nov. 29, 2007

(87) PCT Pub. No.: WO2006/129039

PCT Pub. Date: Dec. 7, 2006

(65) Prior Publication Data

US 2008/0190966 A1 Aug. 14, 2008

(30) Foreign Application Priority Data

Jun. 3, 2005 (FR) ..... 05 51496

(51) Int. Cl.
*B67D 5/40* (2006.01)

(52) U.S. Cl. ..... 222/383.1; 222/383.3

(58) Field of Classification Search ... 222/321.7–321.9, 222/383.1, 383.3, 385, 527
See application file for complete search history.

(56) References Cited

U.S. PATENT DOCUMENTS

| | | | | |
|---|---|---|---|---|
| 2,545,988 | A * | 3/1951 | Bobrick | 222/321.9 |
| 6,089,410 | A * | 7/2000 | Ponton | 222/183 |
| 6,264,120 | B1 * | 7/2001 | Wintering et al. | 239/333 |
| 6,543,653 | B2 * | 4/2003 | Lamboux | 222/321.8 |
| 7,036,691 | B2 * | 5/2006 | Nicolas | 222/321.6 |
| 7,575,132 | B2 * | 8/2009 | Stuart et al. | 222/383.1 |
| 2004/0112924 | A1 * | 6/2004 | Albisetti | 222/402.13 |
| 2006/0076363 | A1 * | 4/2006 | Stuart et al. | 222/321.9 |
| 2006/0157511 | A1 * | 7/2006 | Do Rosario et al. | 222/183 |

FOREIGN PATENT DOCUMENTS

| | | |
|---|---|---|
| DE | 1316514 A | 6/2003 |
| EP | 0361437 A | 4/1990 |
| GB | 2261618 A | 5/1993 |
| WO | 2004012871 A | 2/2004 |

* cited by examiner

*Primary Examiner*—Kevin P Shaver
*Assistant Examiner*—Donnell Long
(74) *Attorney, Agent, or Firm*—Sughrue Mion, PLLC

(57) ABSTRACT

A fluid dispenser head for mounting on a fluid reservoir (R), the dispenser head comprising: a dispenser member (1), such as a pump, for taking the fluid contained in said reservoir, said dispenser member comprising a body (10) and an actuator rod (11) that is axially displaceable in said body; a pusher (7) that is axially displaceable so as to actuate the displacement of the actuator rod (11); a dispenser orifice (60) via which the fluid is dispensed each time the dispenser member (1) is actuated, said orifice (60) being mounted in stationary manner relative to the body (10) and the reservoir (R); and a flexible connection hose (52) that connects the actuator rod (11) to the dispenser orifice (60), said hose including a first connection end (521) that is secured to the actuator rod, and a second connection end (522) that is secured to the dispenser orifice, the dispenser head being characterized in that the first end (521) extends substantially parallel to the actuator rod.

21 Claims, 2 Drawing Sheets

FLUID PRODUCT DISPENSING HEAD AND DEVICE INCORPORATING SAME

The present invention relates to a dispenser head for mounting on or for associating with a fluid reservoir. The invention also relates to a dispenser device incorporating such a head.

Advantageous but non-exclusive fields of application of the present invention are the fields of cosmetics, perfumery, and pharmacy.

Prior-art fluid dispenser devices generally comprise a receptacle filled with fluid, such as a cream, a lotion, a perfume, etc., and a dispenser member, such as a pump or a valve, mounted on a neck formed by the receptacle. The dispenser member is suitable for taking the fluid contained in said receptacle following manual action exerted by a user on a pusher. The dispenser member is usually mounted by means of a fastener ring that is generally made of plastics material. A covering hoop can also be provided in such a manner as to cover the ring at least in part, for the purpose of appearance and/or for blocking the ring on the neck of the receptacle.

More precisely, the dispenser member generally includes a pump body in which a piston slides down and up. The piston is generally secured to an actuator rod that can be displaced axially by pressing on the pusher. Very often, the actuator rod internally defines a duct in which the fluid can flow. The duct is thus put into fluid-flow communication with a dispenser channel formed in the pusher. The dispenser channel thus opens out into an outlet dispenser orifice for the fluid. However, it should be noted that the dispenser member can be actuated by a distinct pusher that defines neither a dispenser channel nor a dispenser orifice. In this event, such a pusher is thus dedicated solely to actuating the dispenser member, and thus does not participate in actually conveying the fluid. The dispenser orifice can thus either be movable, i.e. be displaced simultaneously with the movements of the pusher, or it can be stationary, i.e. remain stationary permanently, thereby being independent of the actuation stroke of the pusher. The dispenser orifice is generally formed by a nozzle. Such a nozzle can thus be qualified either as a movable nozzle or as a stationary nozzle.

Document FR 2 843 639 discloses a fluid dispenser unit that integrates a stationary nozzle. The actuator rod secured to the pusher is then displaced axially, whereas the nozzle remains permanently in a fixed position. The down-and-up axial displacements of the rod are thus compensated by a flexible hose that connects the actuator rod to the nozzle. More precisely, the rod is provided with a connection sleeve and the nozzle is supported by a nozzle holder. The flexible hose connects the sleeve to the nozzle holder. To this end, the hose includes two connection portions that are engaged respectively with the sleeve and with the nozzle holder. In this configuration, it is thus envisaged that both of the connection portions are positioned laterally, preferably on the same side relative to the connection sleeve and the nozzle holder. The flexible hose thus extends in the dispenser head in such a manner as to go away from a plane containing the actuator rod and the stationary nozzle. Such a structure is particularly appropriate for dispenser heads presenting a cross-section that is oblong or ellipsoidal.

A first drawback associated with that type of device is that such a flexible hose that projects radially outwards from the plane containing the actuator rod and the stationary nozzle, is not absolutely compatible with dispenser heads presenting a configuration that is more compact or elongate, such as a configuration that is cubic, spherical, cylindrical, etc. In such an event, there is not enough space in the head to enable the hose to extend laterally. It is not possible to make it shorter, since it must accompany the descent of the actuator rod, and that would thus create substantial tension at the ends of the hose that are connected to the nozzle holder and to the actuator rod.

Another drawback associated with that type of device is that it is difficult to assemble, since such connection means cannot be made as a single part and thus require the hose to be preassembled on the connection sleeve and on the nozzle holder before they are positioned on their corresponding reception structures. Thus, putting such connection means into place turns out to be particularly difficult and not very compatible with mass production.

An object of the present invention is thus to define a fluid dispenser head that overcomes the above-mentioned prior-art drawbacks.

More particularly, an object of the present invention is to define a fluid dispenser head for delivery a stationary spray that is easy to produce and to assemble, and that is less expensive.

An object of the present invention is also to define a dispenser head of small size and of compact shape provided with a stationary nozzle.

To achieve these objects, the present invention proposes a fluid dispenser head for mounting on a fluid reservoir, the dispenser head comprising: a dispenser member, such as a pump, for taking the fluid contained in said reservoir, said dispenser member comprising a body and an actuator rod that is axially displaceable in said body; a pusher that is axially displaceable so as to actuate the displacement of the actuator rod; a dispenser orifice via which the fluid is dispensed each time the dispenser member is actuated, said orifice being mounted in stationary manner relative to the body and the reservoir; and a flexible connection hose that connects the actuator rod to the dispenser orifice, said hose including a first connection end that is secured to the actuator rod, and a second connection end that is secured to the dispenser orifice, the first end extending substantially parallel to the actuator rod. Advantageously, the first end extends substantially in axial alignment with the actuator rod. Thus, the flexible hose no longer extends laterally from the actuator rod as in document FR 2 843 639, but vertically above the actuator rod. This makes it possible to make stationary-spray dispenser heads having a general configuration that is more slender or taller. When the head is tall and narrow, there is no space in the head around the actuator rod. In contrast, there is space above the actuator rod. The first end may be axially offset relative to the rod while remaining substantially parallel. The first end may form an angle relative to the axis of the rod, but the angle should remain small, about 20°.

In another aspect of the invention, the second connection end extends substantially parallel to the first connection end. The second end may form an angle relative to the first end, but the angle should remain small. Advantageously, said actuator rod, said first and second connection ends, and the dispenser orifice extend in a single plane. In practice, this implies that the flexible hose extends in an axial vertical plane, and that it remains in said plane even while the actuator rod is being displaced. The hose deforms at a location that is not situated at its connection ends. The hose advantageously forms a U-shaped loop, and it is the curved portion of the loop that deforms, the ends of the branches being displaced axially without deforming. Consequently, the configuration and the disposition of the flexible hose of the invention are particularly well adapted to heads having a long rod stroke.

According to another characteristic of the invention, the first connection end is provided with a connection sleeve that is connected to the actuator rod, and the second end is provided with a nozzle holder for receiving a nozzle that forms the dispenser orifice, the nozzle holder being mounted in stationary manner relative to the body and the reservoir. The nozzle holder is a kind of dispenser portion from which the fluid is dispensed. The dispenser portion is optionally provided with a nozzle. Advantageously, the connection sleeve and the dispenser portion are made integrally with the flexible connection hose. The axial orientation of the first connection end of the hose connected to the sleeve makes it possible to make the unit by molding plastics material using a rectilinear pin that extends from the sleeve and that forms the duct of the hose. The molding pin extends as far as the nozzle holder.

Advantageously, said first and second connection ends extend above the connection sleeve and the dispenser portion respectively.

Advantageously, the dispenser orifice is situated at an axial height that is substantially identical to the axial height at which the actuator rod is situated in its rest position.

In a variant, the dispenser orifice is situated at an axial height that is lower than the axial height at which the actuator rod is situated in its rest position. This is possible because the second end connected to the nozzle holder extends vertically, parallel to the axis of the actuator rod, and thus occupies only a very small amount of space in the head, the deformation of the hose occurring at its bent portion.

The invention also defines a fluid dispenser including a fluid dispenser head as defined above and associated with a fluid reservoir.

The invention is described more fully below with reference to the accompanying drawings which show an embodiment of the invention by way of non-limiting example. In the figures.

Figure 1:
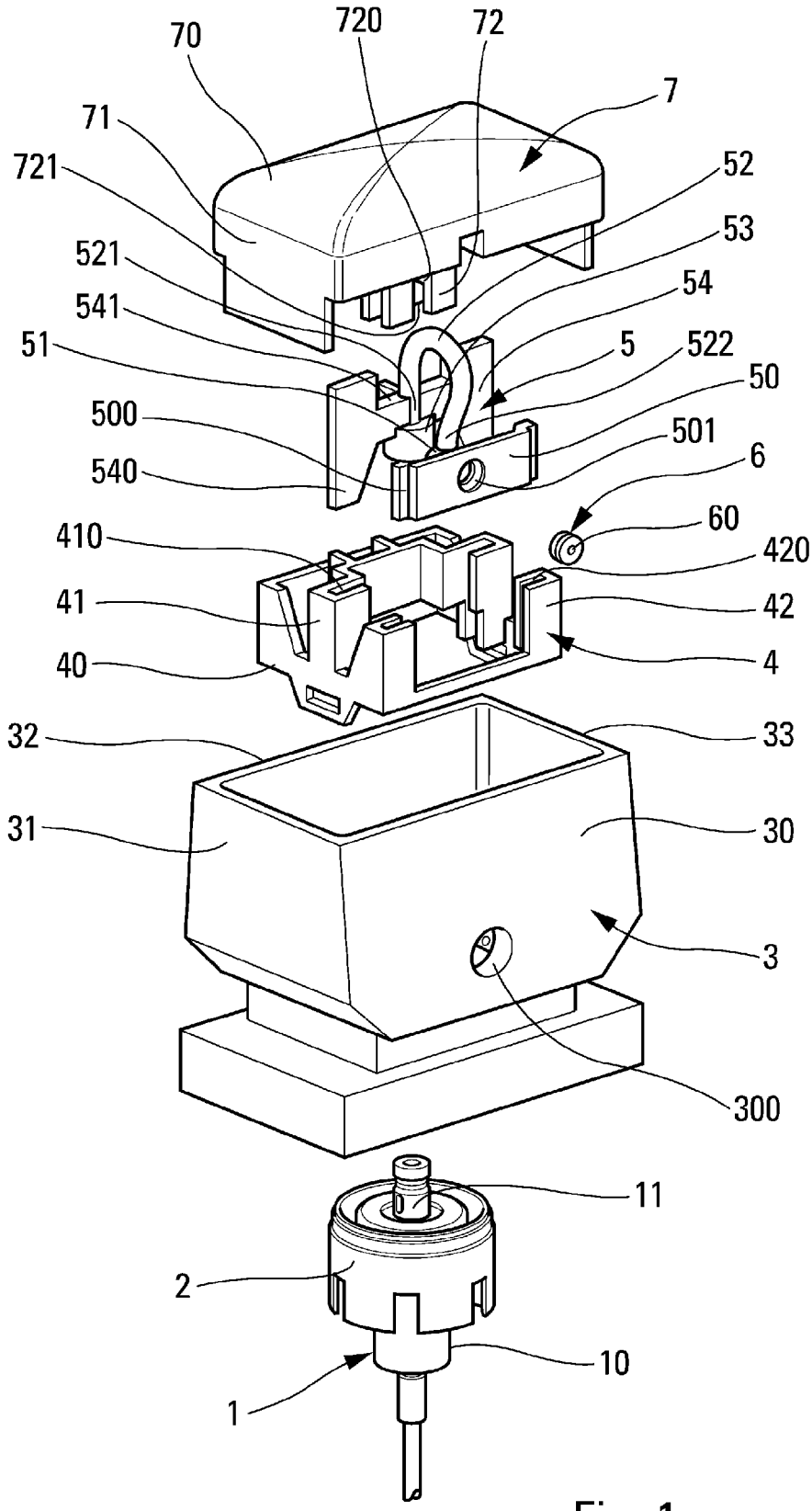
FIG. 1 is an exploded perspective view of a dispenser head of the invention.
Figure 3:
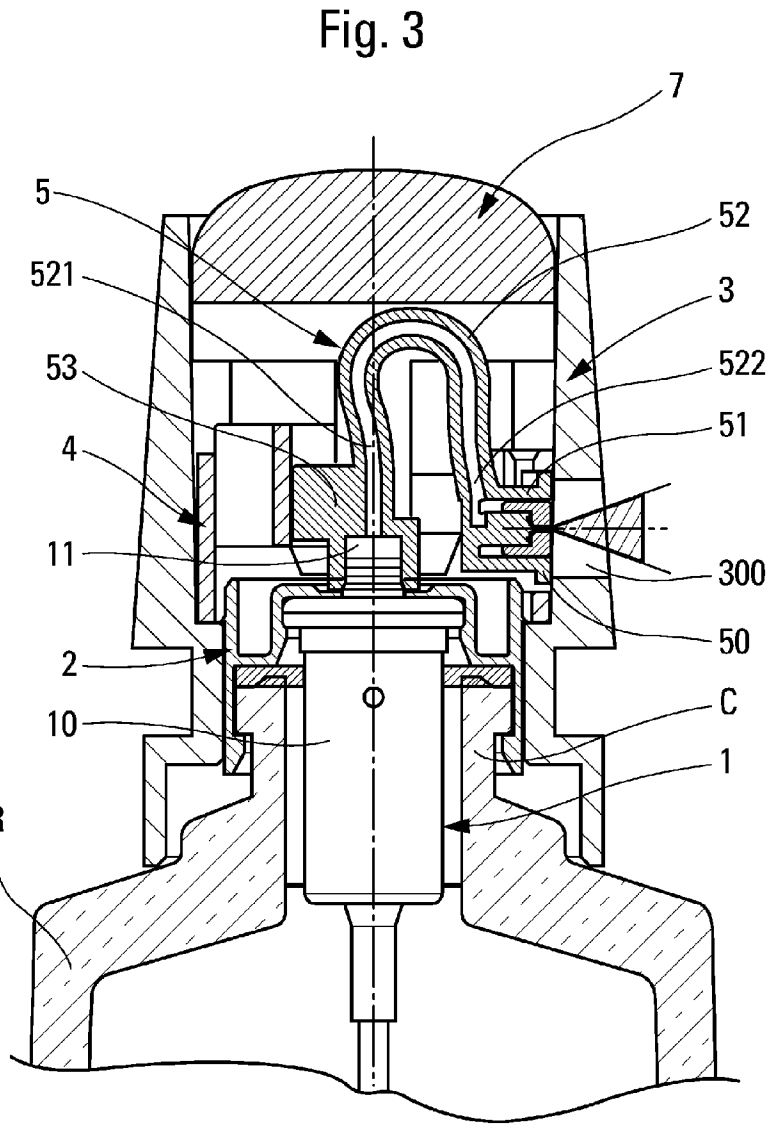
FIG. 3 is a longitudinal section view identical to FIG. 2, but showing a head in the actuated position.
Figure 2:
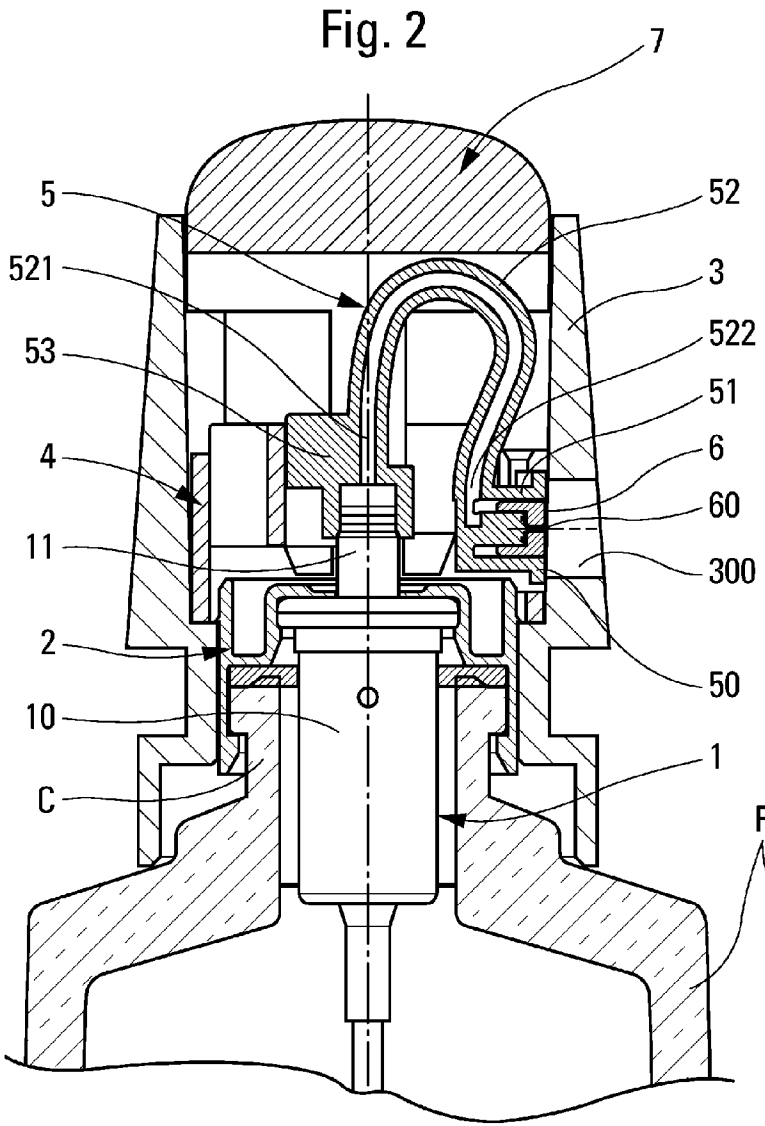
FIG. 2 is a longitudinal section view of a dispenser head of the invention mounted on a fluid reservoir, said head being in the rest position.

The dispenser head of the invention is for associating with a fluid reservoir (shown in FIGS. 2 and 3). The dispenser head co-operates with the fluid reservoir to form a fluid dispenser device. With reference to FIG. 1, the dispenser head comprises a dispenser member 1, a fastener ring 2, a covering hoop 3, an insert 4, an endpiece 5, and a pusher 7.

The dispenser member 1 can be a conventional pump or valve. Taking the example of a pump, the dispenser member 1 comprises a pump body 10 in which there is mounted an actuator rod 11. The actuator rod 11 is generally secured to a piston (not shown) that is suitable for sliding in said pump body in manner made leaktight by friction. The rod, the piston, and the pump body together define a pump chamber that is provided with inlet and outlet valves. In the embodiment shown, the actuator rod internally defines a channel via which fluid can flow following the descent of the rod, together with the piston, in the pump body. The piston and the rod can then be returned to their rest positions under the action of a return spring (not shown) that is generally disposed in the pump body 10. This type of dispenser member is entirely conventional, and is not absolutely critical to the present invention.

As shown in FIGS. 2 and 3, the dispenser member 1 is fastened on a neck C of a reservoir R by means of the fastener ring 2. The fastener ring can be a ring for crimping, screw-fastening, or, as shown, snap-fastening. Since the method of fastening the dispenser member on a reservoir is not critical to the present invention, such fastening is not described in greater detail below.

The covering hoop 3 can be made of plastics material, or of metal. The hoop can present any appropriate configuration, such as a configuration that is parallelepiped, cubic, spherical, egg-shaped, etc. In the present embodiment, the hoop 3 includes four walls: a front wall 30, a rear wall 32, and two side walls 31, 33 that connect the front and rear walls. Each of the walls includes an outside face and an inside face. The front wall 30 has a dispenser opening 300 passing therethrough, thereby connecting the inside face of the front wall to its outside face. The hoop surrounds the ring 2, thereby blocking the ring on the neck. In addition to said blocking function, the hoop has another function that is more of an esthetic function, extending upwards in such a manner as to create an inside space that serves to house the insert 4 and the endpiece 5, with the pusher closing said inside space.

As shown in FIG. 1, the insert 4 is a part of complex shape comprising a frame 40, a guide column 41, and a positioning column 42.

The frame 40 can present any appropriate shape. In the embodiment shown, the frame is rectangular in shape. The frame forms a structure from which various component parts of the insert extend downwards or upwards.

The guide columns 41, that are two in number, extend upwards from the frame 40. In this embodiment, the two guide columns extend substantially facing each other, on the two respective widths of the frame 40 of the insert. In this embodiment, each of the columns includes a guide slot 410. The role of the slots is explained below. In this embodiment, the guide columns occupy a substantially mid-way position at the widths of the frame 40.

The positioning columns 42 extend upwards from the frame 40, substantially further forward than the guide columns 41. The positioning columns that also face each other, extend from two adjacent corners of the frame 40. In the embodiment shown, the columns present L-shaped angle-bar configurations. As shown in FIG. 1, each of the columns includes a positioning groove 420 having a function that is described below.

As shown in FIGS. 2 and 3, the insert 4 is mounted in the hoop 3, and can be held in position in the hoop using any appropriate means.

In the FIG. 1 embodiment, the endpiece 5 comprises different component parts, namely a front portion 50, a dispenser portion 51, a flexible connection hose 52, a connection sleeve 53, and a guide and thrust-transmission portion 54.

In the embodiment shown in FIG. 1, the front portion 50 is generally in the configuration of a rectangular block. The rectangular block defines two short sides from which two slide bars 500 extend in slightly-offset manner. The front portion defines a mounting opening 501 for mounting a nozzle 6.

In this embodiment, the dispenser portion 51 is in the form of a nozzle holder associated with a nozzle 6. The nozzle holder 51 extends rearwards from said front portion 50. The nozzle holder forms a substantially cylindrical portion that is situated in register with the mounting opening 501. The nozzle holder can co-operate with the nozzle 6, when in place, to define a swirl system comprising swirl channels and a swirl chamber opening out into a dispenser orifice 60 formed by the nozzle 6. The nozzle holder and the nozzle define a dispensing axis that is perpendicular to the displacement axis of the rod.

Instead of the nozzle holder, the dispenser portion can be in the form of a dispensing outlet (without a nozzle).

The flexible connection hose 52 respectively connects, via a first connection end 521 and a second connection end 522, the connection sleeve 53 to the nozzle holder 51.

The guide and thrust-transmission portion 54 extends on either side of the connection sleeve 53. The portion 54 comprises two guide fins 540 and a bearing platform 541.

The endpiece 5 is for fastening firstly on the actuator rod 11 by connecting (e.g. by interfitting) the connection sleeve 53 on the free end of the actuator rod 11, and for fastening secondly to the insert 4 by engaging the bars 500 in the grooves 420. When the endpiece 5 is put into place on the insert 4, the mounting opening 501 and thus the dispenser orifice of the nozzle are situated facing the dispenser opening 300 of the hoop. The connection sleeve 53 and the connection end 521 of the hose 52 extend axially, preferably vertically, in alignment with the actuator rod in the mounting position. It is also possible to envisage that the end 521 is offset axially relative to the rod, while remaining parallel thereto. However, it is possible to envisage that the end 521 extends a little off axis.

In the invention, in the mounting position, the first and second connection ends 521 and 522 of the connection hose 52 extend in a plane that coincides with the plane defined by the actuator rod 11 and the dispenser orifice (nozzle). The plane is the section plane in FIGS. 2 and 3.

As shown in the figures, the connection hose 52 presents a horseshoe- or U-shape. The hose preferably extends entirely in the plane defined by the rod 11 and the dispenser opening 300. Thus, in this event, the first and second ends 521, 522 of the hose 52, and the hose 52 itself, are positioned above the connection sleeve and the nozzle holder and not laterally as taught by the prior art, thereby forming an arch above the rod 11 and the nozzle 6. Such a hose thus puts said rod 11 and said nozzle 6 into fluid-flow communication, without worrying about the amount of space that exists on either side of the two elements. Advantageously, the second end 522 also extends substantially axially, i.e. substantially parallel to the first end 521. The second end is substantially perpendicular to the dispensing axis of the nozzle. According to another advantageous characteristic, the nozzle (dispenser orifice) is situated at an axial height that is substantially identical to the axial height at which the actuator rod extends at rest, or it is situated at an axial height that is higher. Such a configuration is thus entirely compatible with dispenser heads that are compact or elongate in shape.

In a particularly preferred embodiment, the connection sleeve 53, the hose 52, and the nozzle holder 51 are made as a single part. Naturally, such an embodiment presents an undeniable advantage from a point of view of manufacturing and assembling the flexible connection means. This is possible as a result of the end 521 extending axially. A molding pin can thus form the inner duct of the hose starting from the sleeve. The hose is molded straight with the sleeve and the nozzle holder, and it is bent subsequently.

The pusher 7 is for being actuated manually by a user. The pusher comprises a top actuator wall 70 and two side guide walls 71. An axial-thrust-transmission block 72 extends downwards from the wall 70. The transmission block comprises two pillars that are spaced apart from each other by a gap 721. Each of the pillars include a recess provided with a bottom web 720 having a function that is described below.

The pusher 7 is for interfitting in the covering hoop 3, and thus for positioning above the insert 4 and the endpiece 5. The pusher 7 controls the displacement of the actuator rod 11 from its rest position, shown in FIG. 2, to its actuated position, shown in FIG. 3. To do this, the pusher 7 that is guided axially by the side walls 31, 33 of the hoop 3 is actuated by the user pressing manually thereon. The bottom webs 720 of the pillars thus come into abutment against the bearing platforms 541. Such abutment thus causes the guide and thrust-transmission portion 54 to descend. The descent is thus guided by the guide fins 540 sliding in the guide slots 410 of the insert 4. The descent of the portion 54 thus actuates the rod 11 that is displaced in the pump body, thereby causing a reduction in the volume of the pump chamber. The fluid contained in the chamber thus reaches the dispenser duct defined internally by the actuator rod 11, then the flexible connection hose 52, before being expelled through the dispenser orifice of the nozzle 6. In addition, it should be observed that a portion of the flexible connection hose 53 can be included in the gap 721. This makes it possible to maintain the orientation of the hose 52, and thus avoid the hose hindering co-operation between the bottom webs 720 and the bearing platforms 541.

Although the present invention is described above with reference to a particular embodiment thereof, naturally it is not limited by said embodiment. On the contrary, any useful modification could be applied thereto by a person skilled in the art, without going beyond the ambit of the present invention, as defined in the accompanying claims.

The invention claimed is:

1. A fluid dispenser head for mounting on a fluid reservoir (R), the dispenser head comprising:

a dispenser member (1) for taking the fluid contained in said reservoir, said dispenser member comprising a body (10) and an actuator rod (11) that is axially displaceable in said body;

a pusher (7) that is axially displaceable in a same direction as the actuator rod so as to actuate the displacement of the actuator rod (11);

a dispenser orifice (60) via which the fluid is dispensed each time the dispenser member (1) is actuated, said orifice (60) being mounted in stationary manner relative to the body (10) and the reservoir (R); and a flexible connection hose (52) that connects the actuator rod (11) to the dispenser orifice (60), said hose including a first connection end (521) that is secured to the actuator rod, and a second connection end (522) that is secured to the dispenser orifice, the first connection end (521) extending substantially parallel to the actuator rod;

the second connection end (522) extends substantially parallel to the first connection end (521).

2. A dispenser head according to claim 1, in which the first connection end (521) extends substantially in axial alignment with the actuator rod.

3. A dispenser head according to claim 1, in which said actuator rod (11), said first and second connection ends (521, 522), and the dispenser orifice (60) extend in a single plane.

4. A dispenser head according to claim 1, in which the first connection end (521) is provided with a connection sleeve (53) that is connected to the actuator rod (11), and the second connection end (522) is provided with a dispenser portion (51) that is made in the form of a nozzle holder for receiving a nozzle (6) that forms the dispenser orifice (60), the nozzle holder being mounted in stationary manner relative to the body (10) and the reservoir (R).

5. A dispenser head according to claim 4, in which the connection sleeve (53) and the dispenser portion (51) are made integrally with the flexible connection hose (52).

6. A fluid dispenser head according to claim 4, in which said first and second connection ends (521, 522) extend above the connection sleeve (53) and the dispenser portion (51) respectively.

7. A dispenser head according to claim 1, in which the dispenser orifice (60) is situated at an axial height that is substantially identical to the axial height at which the actuator rod (11) is situated in its rest position.

8. A dispenser head according to claim 1, in which the dispenser orifice (60) is situated at an axial height that is lower than the axial height at which the actuator rod (11) is situated in its rest position.

9. A dispenser head according to claim 1, in which the actuator rod and the dispenser orifice define a vertical axial plane, the hose (52) extending in said plane, forming a U-shaped loop.

10. A fluid dispenser including a fluid dispenser head according to claim 1 and associated with a fluid reservoir.

11. The dispenser head according to claim 1, wherein in the dispenser member is a pump.

12. The dispenser head according to claim 1, wherein the first connection end is engaged around the actuator rod.

13. A fluid dispenser head for mounting on a fluid reservoir, the dispenser head comprising:

a dispenser member configured to draw fluid from the reservoir, the dispenser member comprising a body and an actuator rod axially displaceable in the body;

a pusher axially displaceable in a same direction as the actuator rod so as to displace the actuator rod;

a dispenser orifice through which the fluid is dispensed each time the dispenser member is actuated, the orifice mounted in stationary manner relative to the body and the reservoir; and a flexible connection hose that connects the actuator rod to the dispenser orifice, the hose comprising a first connection end portion secured to the actuator rod and a second connection end portion secured to the dispenser orifice, the first connection end portion extending substantially parallel to the actuator rod where the first connection end portion is secured to the actuator rod; and the second connection end portion extends substantially parallel to the first connection end portion.

14. The dispenser head according to claim 13, wherein the first connection end portion extends substantially in axial alignment with the actuator rod.

15. The dispenser head according to claim 13, wherein the actuator rod, the first and second connection end portions, and the dispenser orifice extend in a single plane.

16. A dispenser head according to claim 1, wherein the first connection end portion meets with a connection sleeve connected to the actuator rod and the second connection end portion meets with a dispenser portion made in the form of a nozzle holder for receiving a nozzle that forms the dispenser orifice.

17. The dispenser head according to claim 16, wherein the connection sleeve and the dispenser portion are made as an integral one-piece construction with the flexible connection hose.

18. The fluid dispenser head according to claim 16, wherein the first and second connection end portions extend above the connection sleeve and the dispenser portion respectively.

19. The dispenser head according to claim 1, wherein the actuator rod and the dispenser orifice define a vertical axial plane, the hose extending in the plane, forming a U-shaped loop extending upwards from the first connection end portion and downwards towards the second connection end portion.

20. The fluid dispenser comprising a fluid dispenser head according to claim 13, wherein the first connection end portion is engaged around the actuator rod.

21. A fluid dispenser comprising a fluid dispenser head according to claim 13 and a fluid reservoir connected to the fluid dispenser head.

* * * * *